US008365678B2

(12) United States Patent
Morbidelli

(10) Patent No.: US 8,365,678 B2
(45) Date of Patent: Feb. 5, 2013

(54) EXTENSIBLE TABLE

(75) Inventor: Mario Morbidelli, San Giovanni Valdarno (IT)

(73) Assignee: NAOS S.r.l, Figline Valdarno (IT)

( * ) Notice: Subject to any disclaimer, the term of this patent is extended or adjusted under 35 U.S.C. 154(b) by 34 days.

(21) Appl. No.: 13/082,632

(22) Filed: Apr. 8, 2011

(65) Prior Publication Data

US 2011/0247529 A1 Oct. 13, 2011

(30) Foreign Application Priority Data

Apr. 13, 2010 (IT) ..... FI2010A0066

(51) Int. Cl.
*A47B 1/02* (2006.01)

(52) U.S. Cl. ..... 108/85; 108/73

(58) Field of Classification Search ..... 108/87, 108/73, 71, 72, 76, 70, 69, 74, 75, 85, 86, 108/59
See application file for complete search history.

(56) References Cited

U.S. PATENT DOCUMENTS

| | | | | | |
|---|---|---|---|---|---|
| 1,639,510 | A * | 8/1927 | Kruger | 108/73 |
| 1,772,629 | A * | 8/1930 | Goldberg | 108/71 |
| 1,973,894 | A * | 9/1934 | Duncan | 108/73 |
| 1,994,538 | A * | 3/1935 | Segal | 108/73 |
| 2,111,616 | A * | 3/1938 | Creech, Jr. | 108/73 |
| 2,187,133 | A * | 1/1940 | Luppert | 108/73 |
| 2,240,551 | A * | 5/1941 | Cooper | 108/86 |
| 2,456,835 | A * | 12/1948 | Nash | 384/19 |
| 4,553,485 | A * | 11/1985 | Lee | 108/86 |
| 4,794,869 | A * | 1/1989 | Chiu | 108/86 |
| 5,806,437 | A * | 9/1998 | Huang | 108/86 |
| 8,100,063 | B2 * | 1/2012 | Meyers | 108/73 |
| 2006/0032415 | A1 | 2/2006 | Wang | |
| 2007/0289505 | A1 * | 12/2007 | Turenne | 108/73 |

FOREIGN PATENT DOCUMENTS

| | | | |
|---|---|---|---|
| DE | 36 03 614 | A1 | 8/1987 |
| DE | 102004053941 | B3 | 2/2006 |
| EP | 1 815 767 | A2 | 8/2007 |
| FR | 1 272 586 | A | 9/1961 |

* cited by examiner

*Primary Examiner* — Jose V Chen
(74) *Attorney, Agent, or Firm* — McGlew and Tuttle, P.C.

(57) ABSTRACT

The extensible table includes: a main surface (5) supported by a support base (3A, 3B; 3); a first auxiliary surface (19) and a second auxiliary surface (21), arranged underneath the main surface (5) when the table is retracted in a condition of minimum extension and coplanar and side by side to the main surface when the table is extended in the condition of maximum extension; a table extension mechanism. The extension mechanism includes two movable supports (15, 17) arranged side by side, each carrying a respective auxiliary surface (19, 21). The movable supports are supported and guided on the support base of the table for symmetrically and synchronously moving close and away the two auxiliary surfaces one with respect to the other during table extension and retraction movement. Each of the movable supports (15, 17) includes a lifting and lowering member (23A, 23B; 27A, 27B) of the respective auxiliary surface during the table extension and retraction movement.

21 Claims, 9 Drawing Sheets

EXTENSIBLE TABLE

DESCRIPTION

1. Technical Field

The present invention relates to a piece of furniture and more in particular to an extensible table.

2. State of the Art

There are various types of extensible tables and many mechanisms that allow extension of the flat horizontal surface of said tables. Some of these mechanisms are complex and not very efficient, requiring complicated maneuvers and in some cases the presence of two people to obtain correct extension of the support surface.

SUMMARY OF THE INVENTION

The present invention relates in particular to improvements to extensible tables of the type comprising a main surface underneath which auxiliary surfaces are placed, which, according to need are extracted and carried to the height of the main surface to increase the useful surface area of the table.

The object of the invention is to obtain an extensible table of the type described above that is particularly efficient and easy to use, with sturdy and inexpensive extension systems.

Substantially, according to one embodiment of the invention, an extensible table is provided, comprising: a main surface supported by a support base; a first auxiliary surface and a second auxiliary surface, arranged underneath the main surface when the table is retracted in a condition of minimum extension and coplanar and side by side to the main surface when the table is extended in a condition of maximum extension; a table extension mechanism. The extension mechanism comprises two movable supports arranged side by side, each carrying one of the auxiliary surfaces. Moreover, the movable supports are guided on the support base for symmetrically and synchronously moving close and away said first and second auxiliary surfaces one with respect to the other during the table extension and retraction movement. Each of the two movable supports comprises a lifting and lowering member of the respective auxiliary surface during the table extension and retraction movement.

The extension mechanism is simple, sturdy and inexpensive to manufacture, and at the same time allows easy maneuverability in the table extension and retraction movements.

Preferably, the two movable supports are substantially coplanar to obtain a configuration of minimum vertical overall dimension of the extension mechanism.

Advantageously, to obtain symmetrical and simultaneous movement of the movable sup ports, a linkage is provided for mutual connection of said supports. According to some advantageous embodiments, the two movable supports are each constrained to a respective rack; the racks develop parallel to the direction of the extension and retraction movement of the table and mesh with a common toothed wheel.

In some advantageous embodiments of the invention, the movable supports have an open frame development, with a cross element and two respective longitudinal elements, extending parallel to the direction of the extension and retraction movement. Advantageously, to obtain a position of minimum longitudinal overall dimensions in the plane when the table is in folded arrangement, the longitudinal elements of one of said movable supports are side by side to the longitudinal elements of the other, allowing the two movable supports to take an arrangement of minimum longitudinal overall dimensions, with the longitudinal elements placed underneath the main table surface. Preferably, the longitudinal elements can be guided on longitudinal beams carried by the support base of the table. In preferred embodiments of the invention, each longitudinal beam is provided with guiding means on two opposite sides extending along the table extension and retraction direction. The guiding means of each longitudinal beam engage a first longitudinal element of one of the movable supports and a second longitudinal element of the other of the movable supports, so that each movable support is engaged and guided on both of said longitudinal beams.

Preferred embodiments of the invention provide that: each of said lifting and lowering members for the auxiliary surfaces comprises at least one section bar carried by the respective movable support and whereto the respective auxiliary surface is constrained; the section bar has a relative shifting movement with respect to the movable support whereto it is constrained; and during the table extension movement the section bar is locked into a maximum extension position that is reached before the corresponding movable support has reached the maximum extraction position, an overtravel of the movable support with respect to the section bar causing a vertical movement of the section bar and of the auxiliary surface carried thereby, for imposing a shifting movement on said auxiliary surface from a lower position to the height of the main surface. Preferably, this arrangement is double, by providing that each of said lifting and lowering members of the auxiliary surfaces comprises two section bars carried by the respective movable support.

The table extension and retraction mechanism can be completed with an electrical actuator, or can be controlled manually.

Preferably, when the table is provided with an actuator, the latter can be deactivatable, to also allow manual extension.

BRIEF DESCRIPTION OF THE DRAWINGS

The invention will be better understood by following the description and accompanying drawing, which shows practical non-limiting embodiments of the invention. More in particular, in the drawing.

DETAILED DESCRIPTION OF EMBODIMENTS OF THE INVENTION

Figure 3:
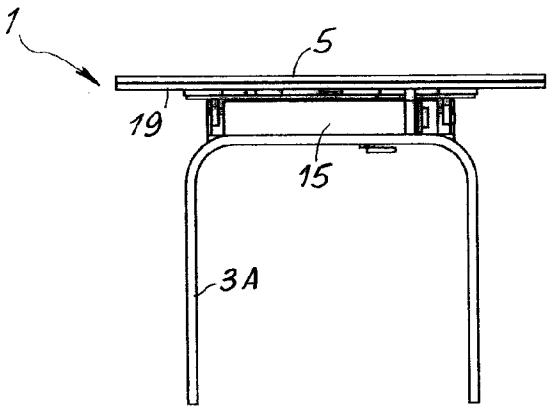
FIG. 3 shows a side view according to III-III of FIG. 1.
Figure 1:
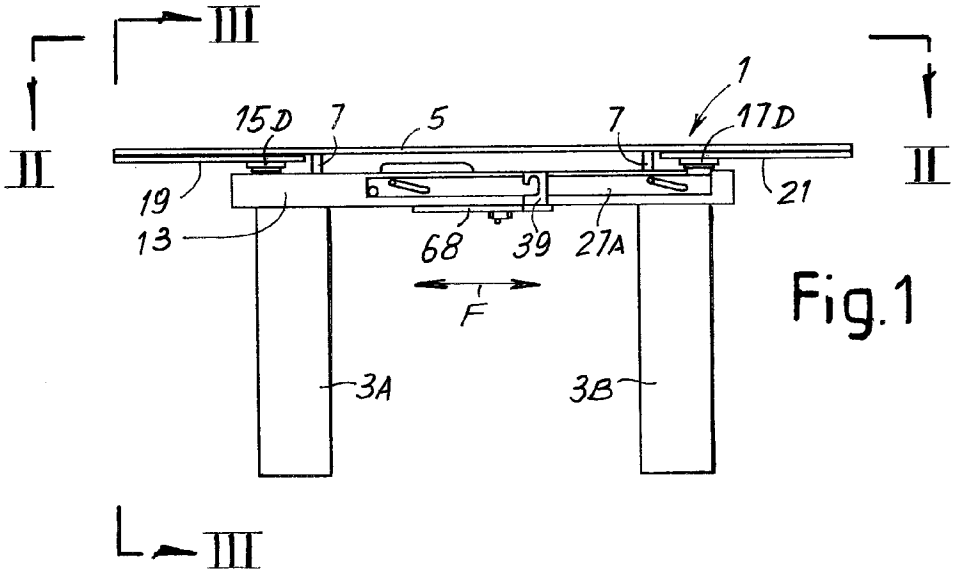
FIG. 1 shows a side view of a table according to the invention in a possible embodiment, in closed arrangement, i.e. retracted, with the auxiliary surfaces placed underneath the main surface.
Figure 2:
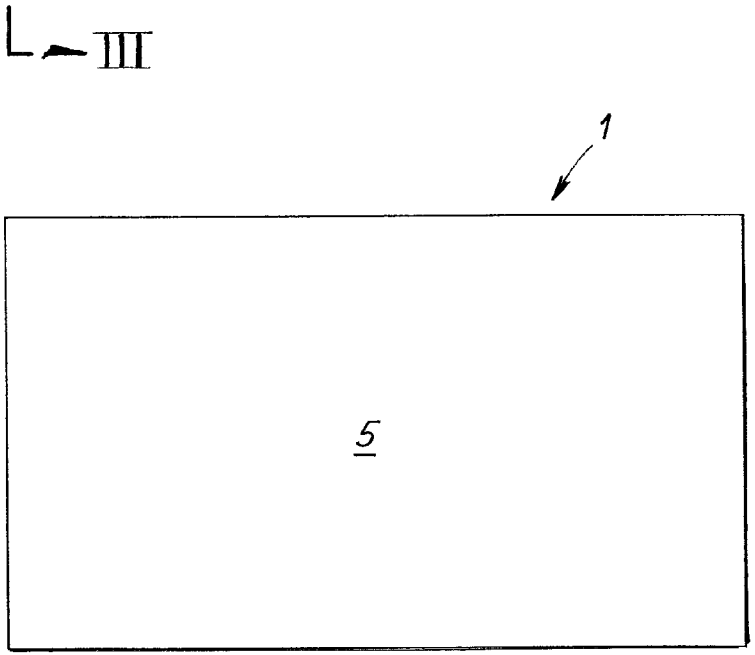
FIG. 2 shows a plan view according to II-II of FIG. 1.

With initial reference to FIGS. 1 to 8, in a first embodiment the table, indicated as a whole with 1, comprises a support base comprising legs for resting on the floor made in any form. In the example shown, the base comprises two legs 3A and 3B in the shape of an upside down U, to which a main surface 5 is fastened. In the example shown the surface 5 is mounted through four support columns 7, shown in particular in FIGS. 7 and 8, where the main surface 5 has been removed to show with greater clarity the functional parts of the extensible table 1. The columns 7 are mounted two by two on a pair of longitudinal beams 11, 13. The longitudinal beams 11 and 13 are fastened to the legs 3A, 3B and form part of the support base of the table 1.

Each longitudinal beam 11, 13 comprises two substantially vertical and opposite longitudinal sides 11A and 13A. In the embodiment shown, guiding means for a pair of movable supports, indicated as a whole with 15 and 17, are positioned on the sides 11A, 13A of the beams 11 and 13. In the embodiment shown the guiding means comprise, for each side 11A, 11A and 13A, 13A of the beams 11 and 13, idle wheels indicated with 11B, 11C for the beam 11 and with 13B, 13C for the beam 13. Two longitudinal elements 17A of the movable support 17 engage with the wheels 11B and 13B of the two beams 11 and 13, while corresponding longitudinal elements 15A of the movable support 15 engage with the wheels 11C, 13C. Each of the longitudinal elements 15A, 17A has respective guiding grooves 17B, 15B, which form a sort of longitudinal tracks in which the wheels 11B, 13B and 11C, 13C engage.

Each movable support 15, 17 is completed by a cross element 15C, 17C, so that in substance each movable support 15, 17 has the shape of an open rectangular frame, i.e. an elongated C-shape or U-shape. The longitudinal elements 15A, 15A, of the movable support 15 are positioned horizontally side by side to the longitudinal elements 17A, 17A of the movable support 17 and, as can be observed from comparing FIGS. 7 and 8, the arrangement is such that the two frames forming the movable supports 15 and 17 can interpenetrate, to take (FIG. 7) an arrangement of minimum length corresponding to the retracted configuration of the extensible table 1, also shown in FIGS. 1 to 3.

Respective connecting members 15D and 17D, to which a first and a second auxiliary surface 19, 21 are fastened, are associated with each movable support 15, 17. The auxiliary surfaces 19, 21 can be fastened, for example by gluing, to the two connecting members 15D, 15D and 17D, 17D of each movable support 15, 17.

The connecting members 15D, 15D of the movable support 15 are fastened to a cross m ember 21 in turn constrained to two longitudinal profiles 23A, 23B connected as described below to the movable support 15. Similarly, the connecting members 17D are fastened to a cross member 25, in turn constrained to two section bars 27A, 27B, connected to the movable support 17.

Each section bar 23A, 23B and 27A, 27B is fastened to a respective longitudinal element 15A, 15A and 17A, 17A of the first movable support 15 and of the second movable support 17 by means of cross pins 29 that engage in respective inclined slots 31 provided on each of the section bars 23A, 23B and 27A, 27B. This arrangement allows a relative shifting movement, according to an inclined direction corresponding to the longitudinal axis of the slots 31, between each section bar 23A, 23B, 27A, 27B and the corresponding longitudinal element 15A, 15A or 17A, 17A of the corresponding movable support 15, 17.

Each section bar 23A, 23B, 27A, 27B has a roller 33 positioned in proximity of the end of the respective section bar farthest from the cross member 25 or 21. Each roller 33 cooperates with a respective shaped stop 35, 37 relative to the support 15 and 39, 41 relative to the movable support 17. The shaped stops 35, 37, 39, 41 are rigidly connected to the base formed by the legs 3A, 3B and by the beams 11, 13. Each shaped stop 35, 37, 39, 41 has a curved edge with a substantially horizontal portion, a substantially vertical portion and an upside down U-shaped upper curved portion, in which the roller 33 of the respective section bar 23A, 23*b*, 27A, 27B engages.

As will be more apparent below, this arrangement allows a relative lifting movement of the connecting m embers 15D, 17D integral with the section bars 23A, 23B, 27A, 27B when the table is extended, so as to carry the auxiliary surfaces 19, 21 (placed under the main surface 5 when the table is retracted) to a position coplanar with the main surface 5 when the table is in extended position.

Each of the movable supports 15, 17 is constrained to a bar on which a rack, indicated with 45 for the movable support 15 and with 47 for the movable support 17, is provided. The two racks 45, 47 are substantially parallel and develop according to the direction (arrow F) of the extension and retraction movement of the table 1. A toothed wheel 49 is provided in an approximately central position of the support base. In the example shown, the toothed wheel 49 has a substantially vertical axis of rotation carried by the base of the table, in an intermediate position between the racks 45, 47. These latter are arranged so as to mesh in opposite positions with the toothed wheel 49. In this way the extension and retraction movement according to the double arrow F of the movable supports 15, 17 is synchronous for the two supports. By pulling, for example, the support 15, the movement according to the arrow F of this support causes a simultaneous and sym metrical movement of the movable support 17 due to meshing of the racks 45, 47 with the toothed wheel 49 which, in this embodiment, is idly supported on the base of the table 1.

Figure 6:
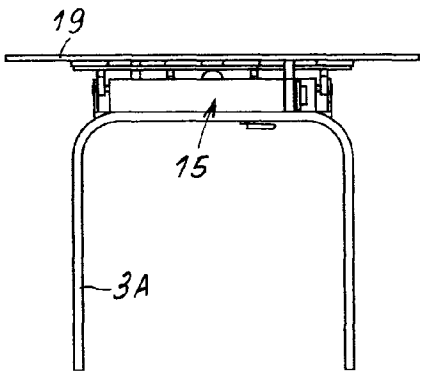
FIGS. 4, 5, 6 show figures analogous to FIGS. 1, 2, 3, but with the table in extended arrangement, i.e. with the auxiliary surfaces aligned coplanar with the main surface.
Figure 4:
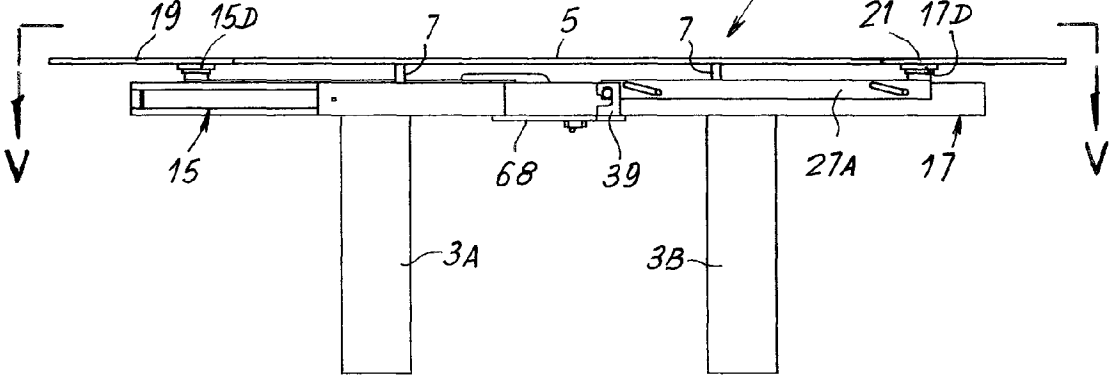
Figure 5:
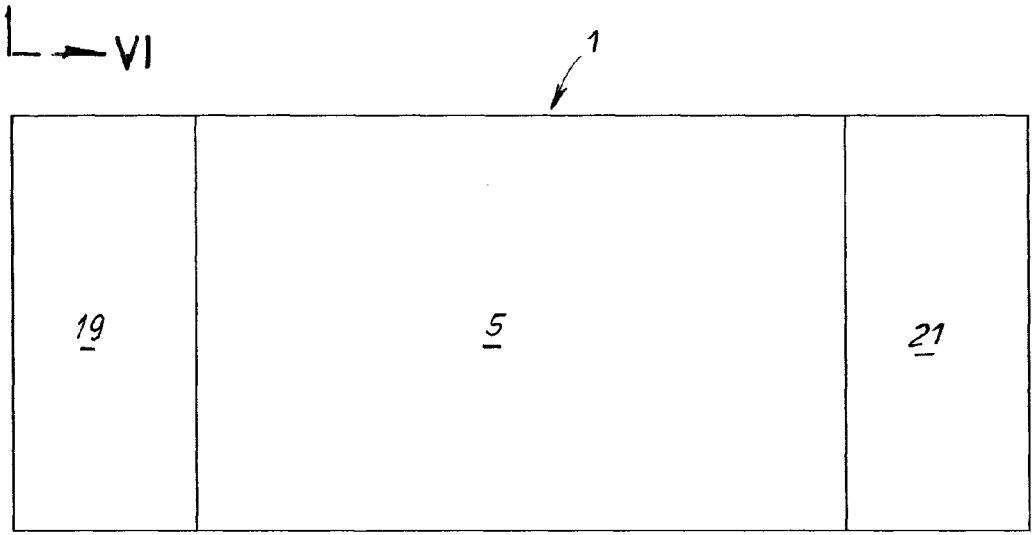
Figure 7:
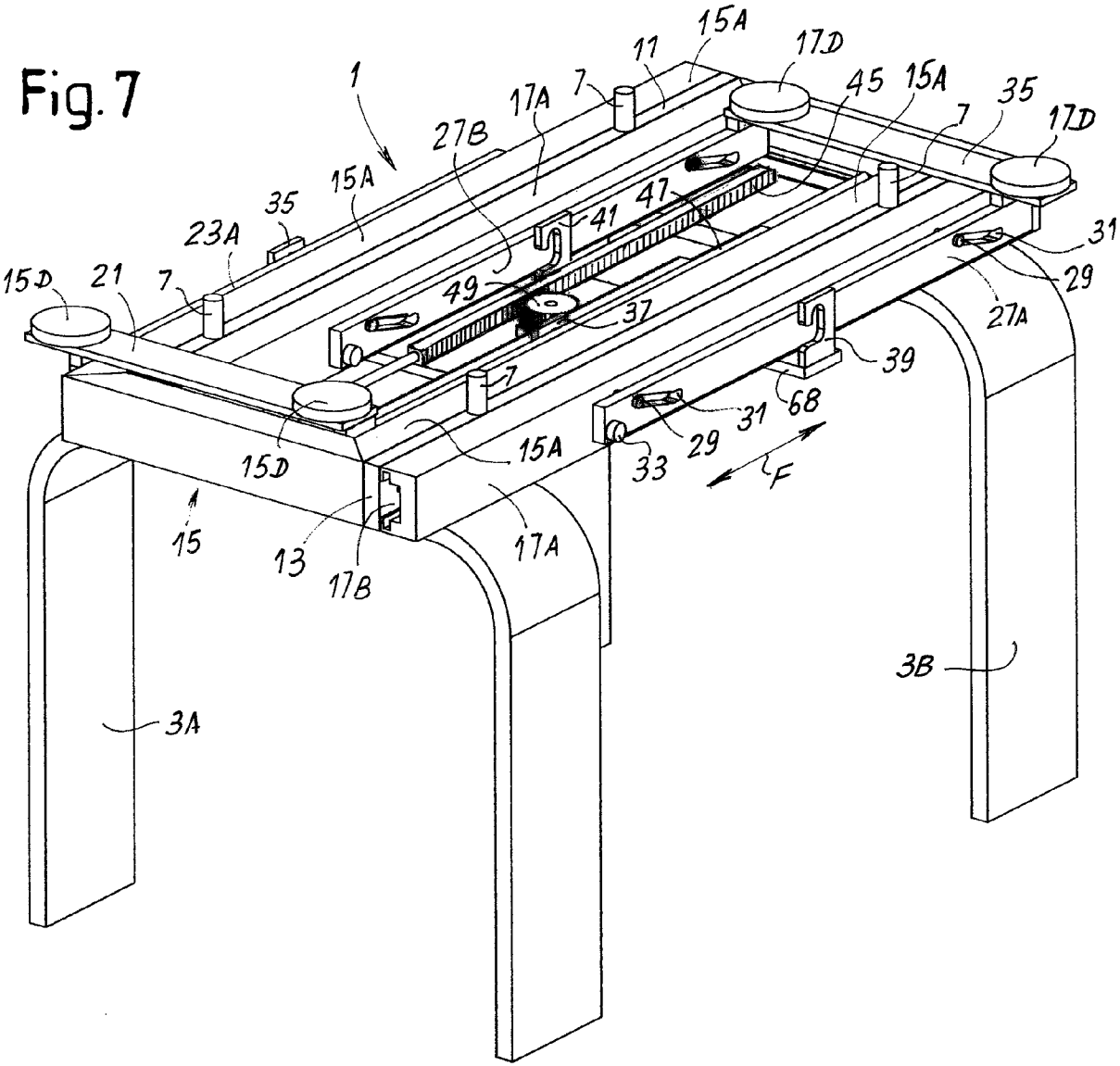
FIGS. 7 and 8 show axonometric views of the table according to the invention in retracted arrangement and in extended arrangement, respectively, without the support surfaces for clearer representation of the extension mechanisms.
Figure 8:
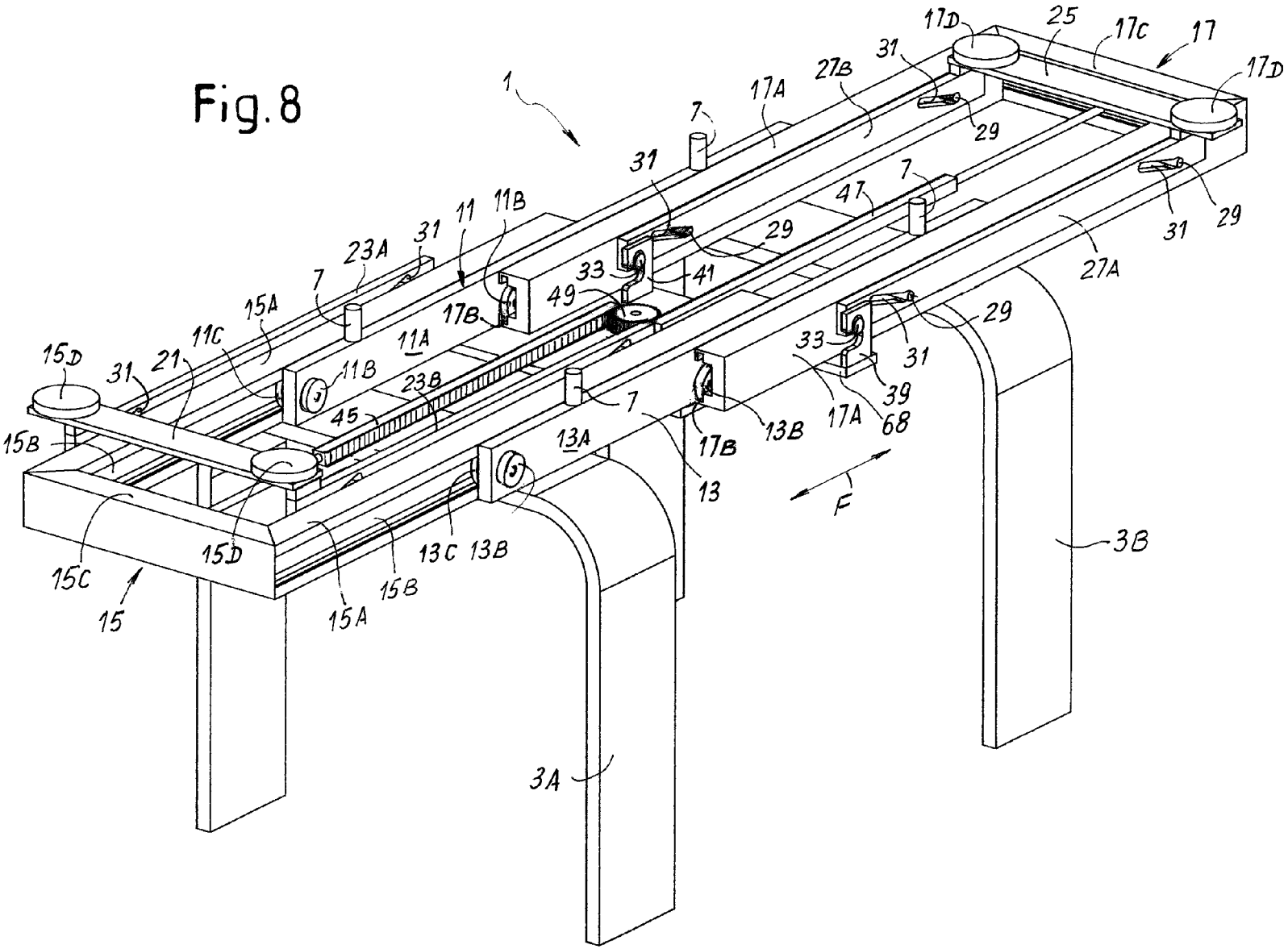
Figure 9:
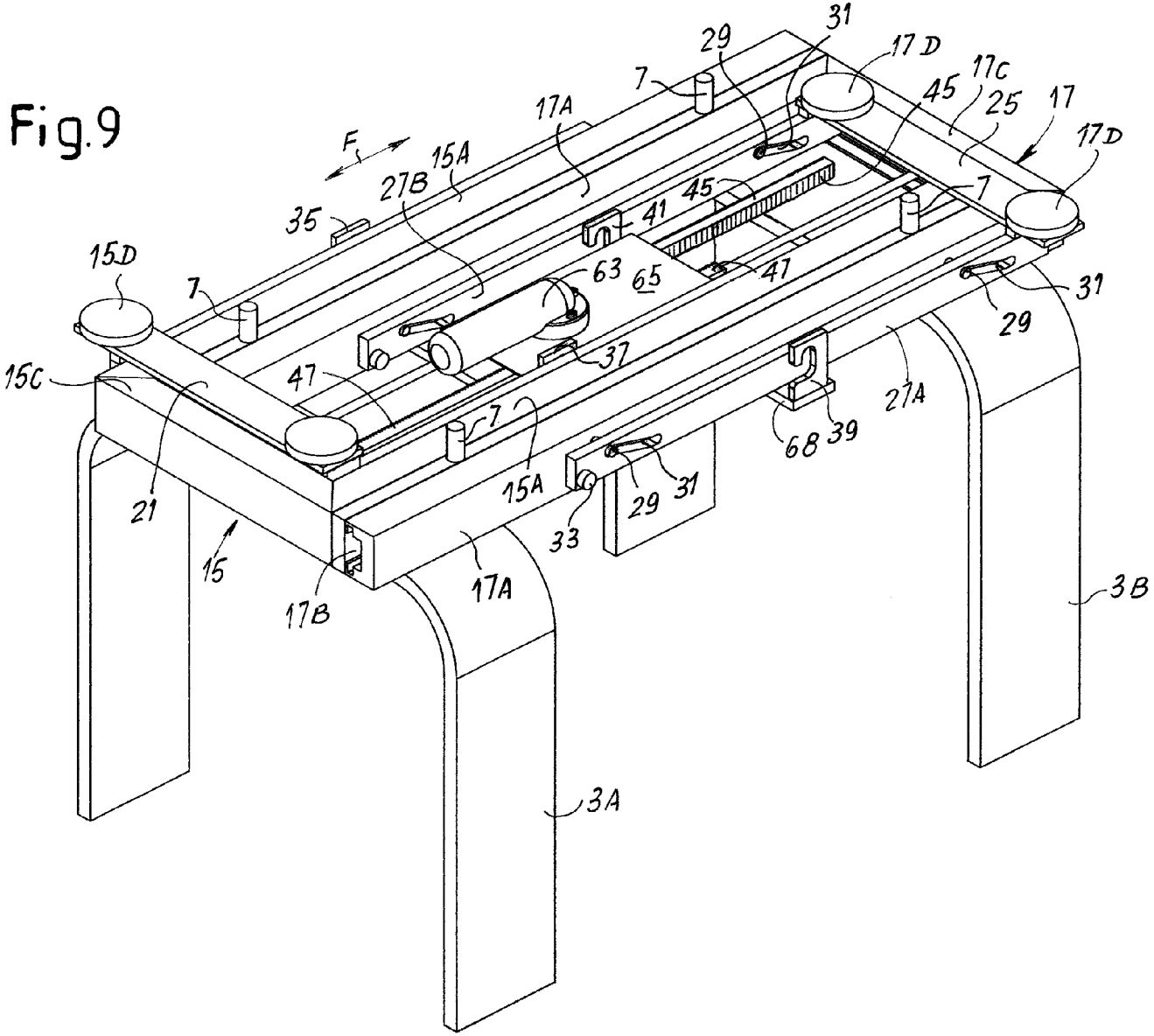
FIGS. 9 and 10 show axonometric views similar to those of FIGS. 7 and 8 in a modified embodiment with a motorized mechanism for extension and retraction of the table.
Figure 10:
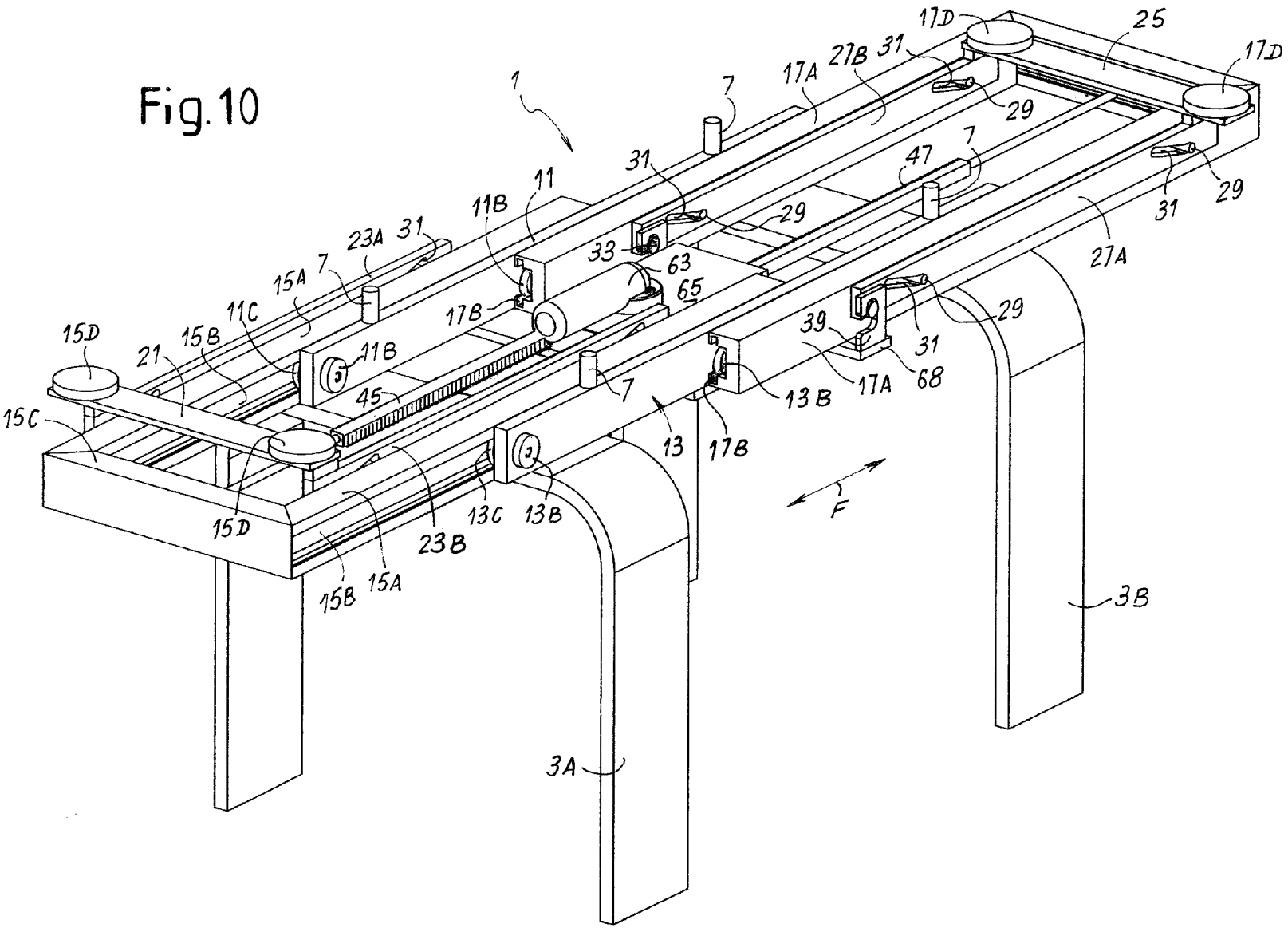

As can be understood by comparing FIGS. 7 and 8, when the movable supports 15, 17 are extracted, i.e. moved away one with respect to the other, they draw with them the section bars 23A, 23B and 27A, 27B due to engagement of the pins 29 in the slots 31. However, these section bars do not follow the whole of the movement of the movable supports 15, 17 but are locked due to engagement of the rollers 33 in the shaped stops 35, 37 for the section bars 23A, 23B and 39, 41 for the shaped section bars 27A, 27B. The overtravel of the movable supports 15, 17 with respect to the section bars 23A, 23B and 27A, 27B causes sliding of the pins 29 along the slots 31 and consequent lifting, without further horizontal movement, of the section bars 23A, 23B and 27A, 27B. The lifting movement is simultaneous for the two pairs of section bars as a result of the connection mechanism defined by the racks 47, 45 and by the toothed wheel 49. This lifting movement causes lifting of the auxiliary surfaces 19, 21 from the lower position, underneath the main surface 5, to the height of this latter (FIGS. 4 and 6). The position of the shaped stops 35, 37, 39, 41 is such that the lifting movement of the auxiliary surfaces 19, 21 takes place when these are outside the overall dimensions of the main surface 5 and substantially in exact correspondence with the cross edges thereof, so that in the extended arrangement a single support surface, defined by the auxiliary surfaces 19, 21 and by the main surface 5, is formed (FIG. 4) with the smallest possible space between each auxiliary surface 19, 21 and the main surface 5.

The shortening, i.e. retraction, movement of the table takes place in reverse, simply by pushing one or the other of the two movable supports 15, 17 toward the base 3A, 3B, 11, 13. This movement initially causes lowering of the auxiliary surfaces 19, 21 underneath the level of the main surface 5 and subsequently disappearance of the surfaces 19, 21 underneath the main surface 5 with approach and interpenetration of the U-shaped frames forming the movable supports 15, 17.

Both in the extension movement and in the lowering movement it is sufficient to act on one of the two movable supports 15, 17 or directly on the auxiliary surfaces 19, 21 moving them with respect to the table base. The other of the two movable supports with the relative auxiliary surface carries out a symmetrical movement due to the toothed wheel and rack device.

The embodiment of FIGS. 9 to 14 differs from the embodiment described above due to the use of an electrical actuator that can be used to carry out the table extension and retraction movement. The same numbers indicate in FIGS. 9 to 14 parts that are the same as or equivalent to those of FIGS. 1 to 8. Only the additional components with respect to those described with reference to the previous embodiment shall be described below.

In this embodiment, the toothed wheel 49 (see details of FIGS. 11 and 12) meshes with a pinion 61 motorized by means of an electrical actuator 63, for example powered by a battery on board the table (not shown) and controlled with a remote control (also not shown) or by means of control members on board the table. The actuator 63 is mounted on a plate 65 provided with slots 67 by means of which the plate 65 is connected to the table base. This allows a movement according to the arrow f65 of the plate 65 and consequently of the actuator 63 with its pinion 61 with respect to the toothed wheel 49 which, vice versa, is mounted with its axis fixed relative to the table base 1.

Figure 11:
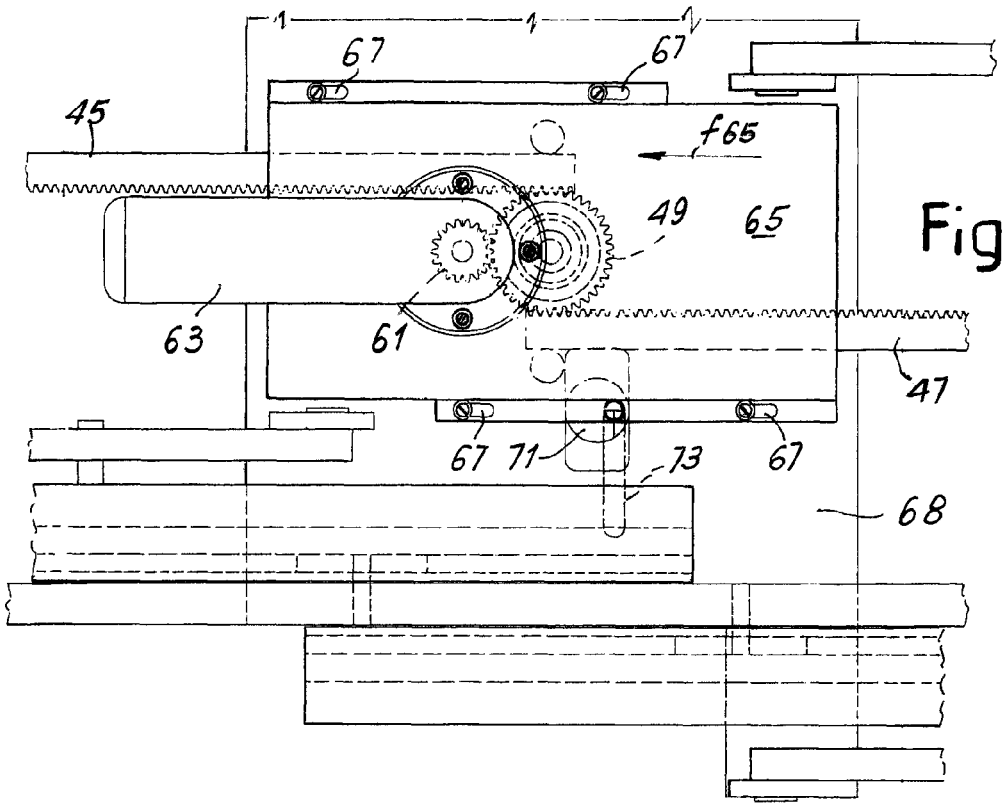
FIGS. 11 and 12 show schematic plan views of the motorized table extension and retraction mechanism.
Figure 12:
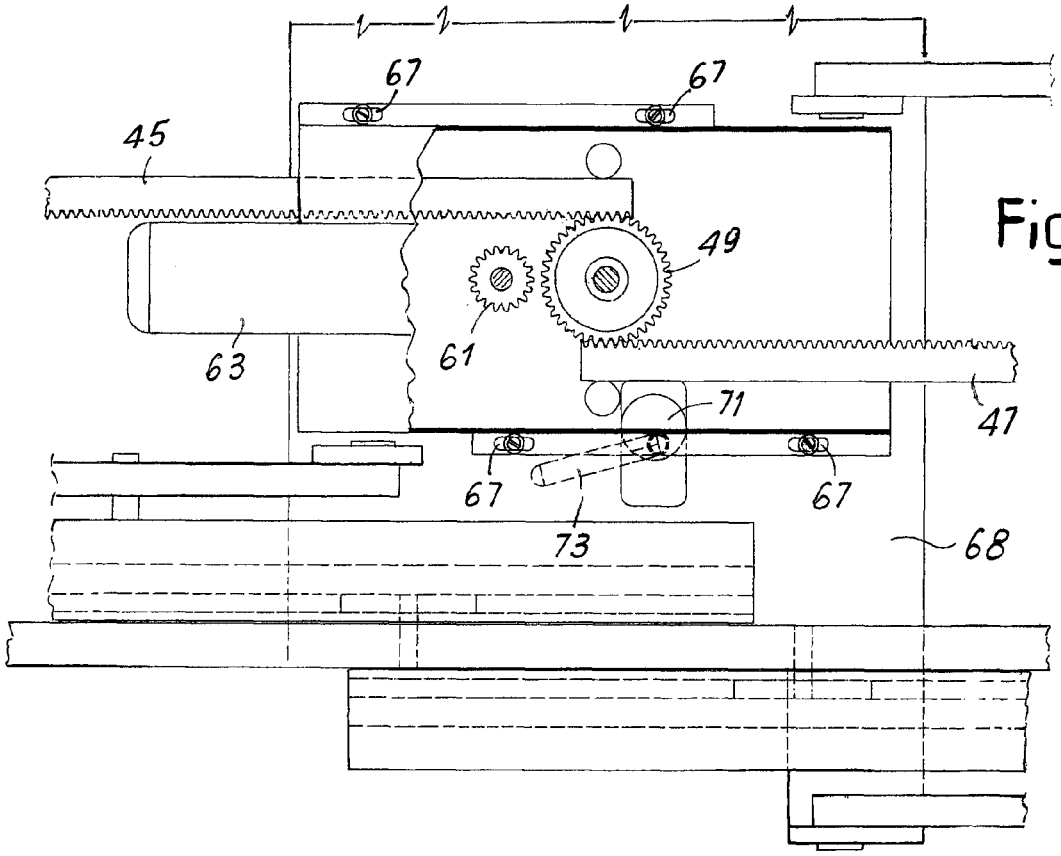
Figure 13:
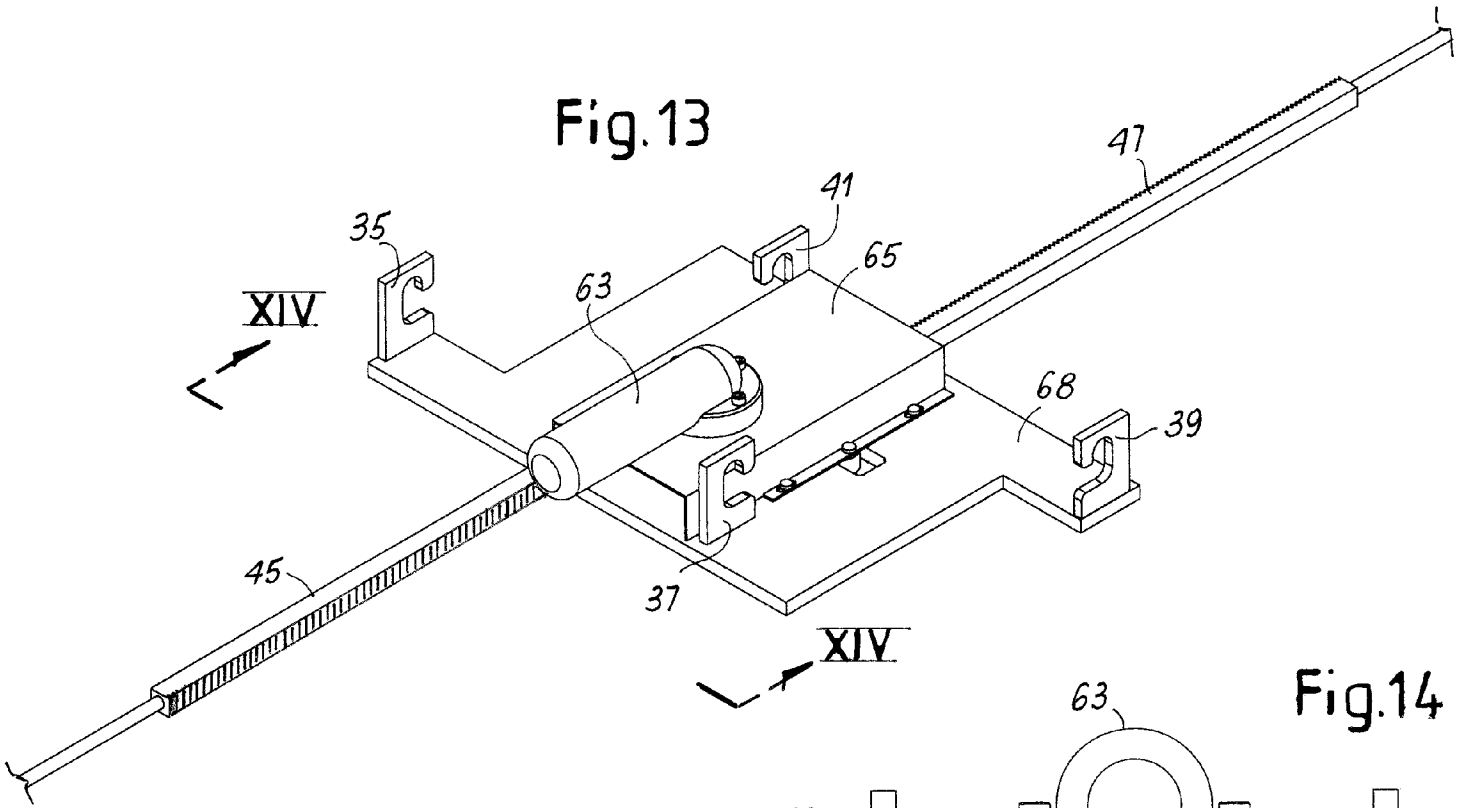
FIG. 13 shows an axonometric view of the motorized mechanism of FIGS. 11 and 12.
Figure 14:
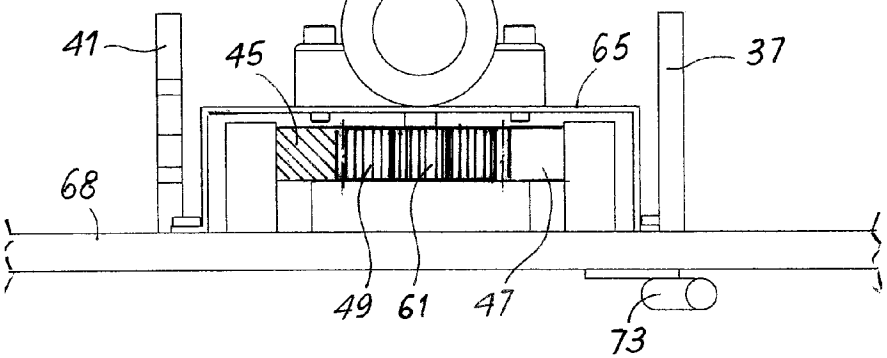
FIG. 14 shows a view according to a vertical plane with the trace XIV-XIV of FIG. 13.
Figure 16:
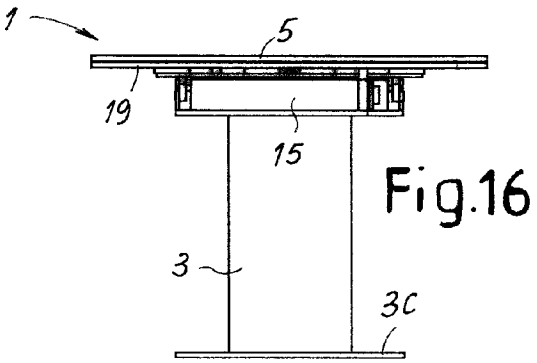
FIGS. 15 and 16 show a side view and a front view according to XVI-XVI of FIG. 15 of a modified of embodiment of a table according to the invention in retracted arrangement.
Figure 18:
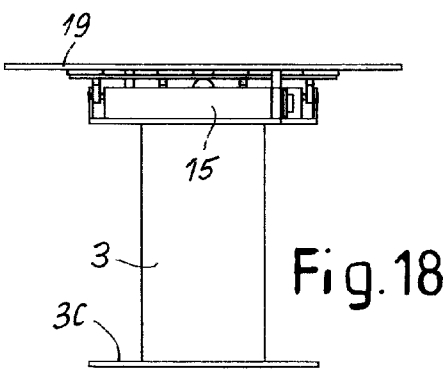
FIGS. 17 and 18 show views similar to the view of FIGS. 15 and 16 with the table in extended arrangement.
Figure 15:
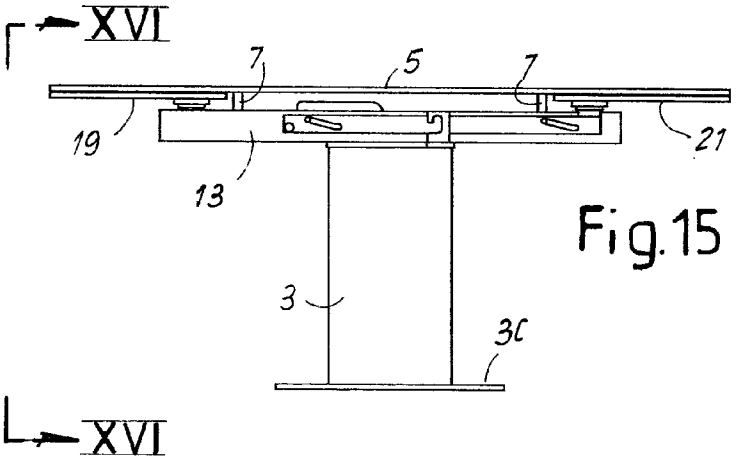
Figure 17:
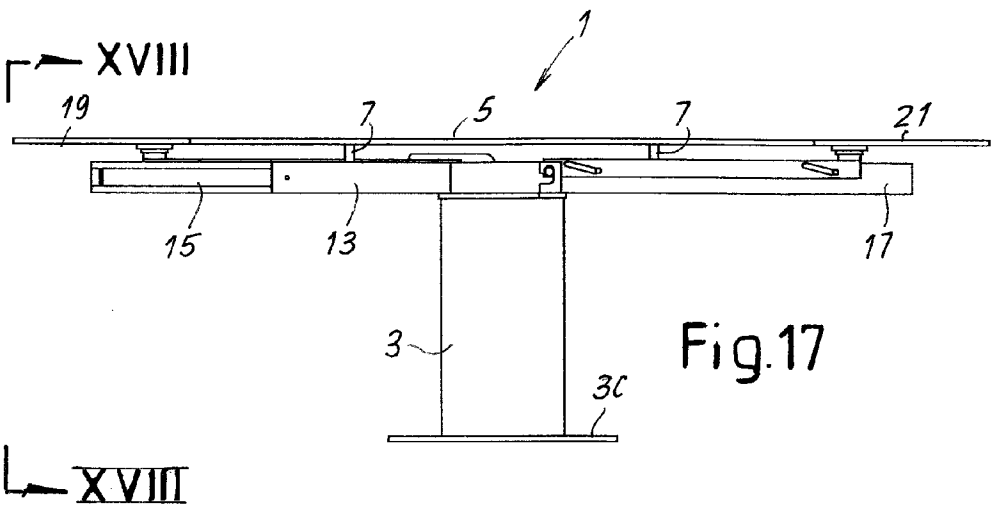

FIGS. 11 and 12 show two positions that the plate 65 and consequently the actuator 63 and motorized pinion 61 can take with respect to the toothed wheel 49. In the arrangement of FIG. 11 the pinion 61 meshes with the wheel 49, while in FIG. 12 the pinion 61 has been moved to a released position relative to the toothed wheel 49. Consequently, in the arrangement of FIG. 12 the table can be extended with a manual maneuver as described above with reference to the embodiment of FIGS. 1 to 8, for example in the case of a fault of the electrical actuator 63 or depletion of the power batteries. Vice versa, in the arrangement of FIG. 11 the table extension and retraction movements can be obtained by operation of the electrical actuator 63 which by means of the pinion 61 carries in rotation the toothed wheel 49 and consequently causes shifting in opposite directions (with synchronous and symmetrical movement of the two racks 45, 47) of the moving supports 15 and 17.

In the example shown the plate 65 is fastened by means of the slots 67 to a base plate 68 on which the shaped stops 35, 37, 39 and 41 are also fastened. The base plate 68 is advantageously fastened to the table legs 3A and 3B and forms an integral part of the fixed support base, relative to which the two moving supports 15, 17 are made to shift in the table extension and retraction movement.

To obtain shifting according to the arrow f65 of the plate 65 and of the actuator 63 relative to the table base 1, a mechanism with an eccentric 71 and a lever 73 can be provided, shown in particular in FIGS. 11 and 12. The mechanism 71, 73 can be operated to carry the device to the arrangement of FIG. 12 for example when the electrical actuator 63 is broken or when its battery is depleted, or for any other reason, when wishing to carry out table extension or retraction with a manual operation.

It is understood that the configuration of the plate 65 and the actuator 63 with the respective pinion 61 is such that this unit can be applied to a table 1 with very simple operations that allow, for example, a manually operated table 1 to be completed with a motorized unit also extemporaneously.

FIGS. 15, 16 and 17, 18 respectively show, in retracted and extended arrangement, another table according to the invention that differs from the previous embodiments due to the shape of the base, which in this case has a single column 3 with a base 3C for resting on the floor. The remaining components can be made as described with reference to FIGS. 1 to 15.

It is understood that the drawing shows just one example, provided merely as a practical demonstration of the invention, which can vary in its forms and arrangements, without however departing from the scope of the concept underlying the invention. Any reference numbers in the appended claims are provided to facilitate reading of the claims with reference to the description and to the drawing, and do not limit the scope of protection represented by the claims.

The invention claimed is:

1. An extensible table comprising:

a main surface supported by a support base;

a first auxiliary surface and a second auxiliary surface, arranged underneath the main surface when the table is retracted in a condition of minimum extension and coplanar and side by side to the main surface when the table is extended in the condition of maximum extension;

a table extension mechanism, wherein said extension mechanism comprises two movable supports arranged side by side, each of said movable supports carrying one of said first auxiliary surface and said second auxiliary surface and supported and guided on said support base, wherein each of said movable supports comprises a lifting and lowering member of the respective auxiliary surface during the table extension and retraction movement, each of said movable supports being connected to a respective rack, said racks extending parallel to a direction of the extension and retraction movement of the table, said racks being connected to a common toothed wheel arranged between said racks, said common toothed wheel being supported by said support base, said common toothed wheel and said racks forming a kinematic connection, said movable supports being connected to one another and to said support base via said kinematic connection, said kinematic connection applying synchronous and symmetrical movement to said two movable supports when moving said first auxiliary surface and said second auxiliary surface relative to each other during the table extension and retraction movement.

2. An extensible table according to claim 1, wherein said two movable supports are substantially coplanar.

3. An extensible table according to claim 1, wherein said toothed wheel has an axis of rotation substantially orthogonal to the support surfaces of the table.

4. An extensible table according to claim 1, wherein said movable supports have an open frame development, with a cross element and two longitudinal elements, extending parallel to the direction of the extension and retraction movement.

5. An extensible table according to claim 4, wherein the longitudinal elements of one of said movable supports are side by side to the longitudinal elements of another one of said movable supports, allowing the two movable supports to take an arrangement of minimum longitudinal overall dimensions, with the longitudinal elements placed underneath the main table surface.

6. An extensible table according to claim 4, wherein said longitudinal elements are guided on longitudinal beams carried by said support base.

7. An extensible table according to claim 6, wherein each longitudinal beam is provided with a respective guiding device on each one of two opposite sides extending along the table extension and retraction direction, with the guiding devices of each longitudinal beam engaging a first longitudinal element of one of said movable supports and a second longitudinal element of another one of said movable supports, each movable support being engaged and guided on both of said longitudinal beams.

8. An extensible table according to claim 1, wherein:

each of said lifting and lowering members for the auxiliary surfaces comprises at least one bar carried by the respective movable support and whereto the respective auxiliary surface is constrained;

said bar has a shifting movement relative to the movable support whereto it is constrained; and during the table extension movement the bar is locked in a maximum exten-sion position that is reached before the corresponding movable support has reached the maximum extraction position, an overtravel of the movable support relative to the bar causing a vertical movement of the bar and of the auxiliary surface carried thereby, for imposing a shifting movement on said auxiliary surface from a lower position to a height of the main surface.

9. An extensible table according to claim 8, wherein said shifting movement of the auxiliary surface is a movement in a substantially vertical direction.

10. An extensible table as claimed in claim 1, wherein:

each of said lifting and lowering members for the auxiliary surfaces comprises two bars carried by the respective movable support and whereto the respective auxiliary surface is constrained;

said two bars have a relative shifting movement with respect to the movable support whereto they are constrained; and during the table extension movement the bars are locked in a maximum extension position that is reached before the corresponding movable support has reached the maximum extraction position, an overtravel of the movable support relative to the bars causing a vertical movement of the bars and of the auxiliary surfaces carried thereby, for imposing a shifting movement on said auxiliary surface from a lower position to a height of the main surface.

11. An extensible table according to claim 10, wherein said shifting move-ment of the auxiliary surface is a movement in a substantially vertical direction.

12. An extensible table according to claim 1, further comprising an electrical motor for rotating said toothed wheel and controlling the extension and retraction movement of the table.

13. An extensible table according to claim 12, wherein said electrical motor is provided with an engaging and disengaging movement with respect to said toothed wheel for disengaging said electric motor from said toothed wheel and allowing manual table extension.

14. An extensible table according to claim 13, wherein said electrical motor comprises a motorized pinion for connecting with said toothed wheel, said motorized pinion selectively engaging and disengaging said toothed wheel via said engaging and disengaging movement of said electric motor.

15. An extensible table according to claim 12, wherein said electrical motor is remote-controlled.

16. An extensible table according to claim 12, wherein said electrical motor is powered by a battery on board the table.

17. An extensible table according to claim 12, wherein said electric motor is carried by a plate, said plate being connected to said support base.

18. An extensible table according to claim 17, wherein said plate is movable with respect to the support base for moving the electric motor to a position disengaged from the table extension mechanism.

19. An extensible table comprising:

a main surface supported by a support base;

a first auxiliary surface and a second auxiliary surface, arranged underneath the main surface when the table is retracted in a state of minimum extension, said first auxiliary surface and said second auxiliary surface being coplanar and side by side to the main surface when the table is extended in a state of maximum extension;

a table extension mechanism, said extension mechanism comprising two movable supports arranged side by side, each of said movable supports carrying one of said first auxiliary surface and said second auxiliary surface, each of said movable supports being supported and guided on said support base, said two movable supports being configured and arranged for symmetrical and synchronous movement relative to each other during extension and retraction movement of the table, each of said movable supports comprising a lifting and lowering member of one of said first auxiliary surface and said second auxiliary surface during the extension and retraction movement of the table, each of said movable supports having an open frame development, with a cross element and two longitudinal elements, extending parallel to a direction of the extension and retraction movement of the table, wherein two longitudinal beams are provided on said support base, said two longitudinal beams extending in the direction of the extension and retraction movement of the table and said two longitudinal beams extending parallel to said longitudinal elements of said movable supports, each of said longitudinal beams being provided with a respective guiding device on each one of two opposite longitudinal sides thereof, wherein a first longitudinal element of one of said movable supports and a second longitudinal element of another one of said movable supports engages the guiding devices on opposite longitudinal sides of each of said longitudinal beams, whereby each of said movable supports engages said two longitudinal beams and each of said movable supports is guided on said two longitudinal beams.

20. An extensible table according to claim 19, wherein:

each of said lifting and lowering members for the first auxiliary surface and the second auxiliary surface comprises at least one bar carried by one of said movable supports and a respective one of said first auxiliary surface and said second auxiliary surface is connected to said at least one bar;

said bar has a shifting movement relative to the movable support whereto said bar is connected; and during the table extension movement the bar is locked in a maximum extension position that is reached before the corresponding movable support has reached the maximum extraction position, an overtravel of the movable support relative to the bar causing a vertical movement of the bar and of the auxiliary surface carried thereby, for imposing a shifting movement on said auxiliary surface from a lower position to a height of the main surface.

21. An extensible table according to claim 19, wherein a guiding means comprises idle wheels supported by said longitudinal beams and engaging in sliding guides provided in the two longitudinal elements of said movable supports.

* * * * *